US005167189A

United States Patent [19]

Jones

[11] Patent Number: 5,167,189

[45] Date of Patent: Dec. 1, 1992

[54] CYLINDER IMPURITY REMOVER APPARATUS

[76] Inventor: Phillip W. Jones, R.R. #1, Box 332B, Mulvane, Kans. 67110

[21] Appl. No.: 790,673

[22] Filed: Nov. 8, 1991

[51] Int. Cl.[5] ..... B41F 35/02; B41L 41/02

[52] U.S. Cl. ..... 101/423; 101/425

[58] Field of Search ..... 101/423, 424, 425

[56] References Cited

U.S. PATENT DOCUMENTS

| | | | |
|---|---|---|---|
| 2,704,026 | 3/1955 | Rogge et al. | 101/425 |
| 3,601,051 | 8/1971 | Gegenheimer et al. | 101/425 |
| 4,499,827 | 2/1985 | Takeuchi et al. | 101/141 |
| 4,782,756 | 11/1988 | Howard | 101/425 |
| 4,789,432 | 12/1988 | Goodnow et al. | 101/425 |
| 4,852,492 | 8/1989 | Pfizenmaier | 101/423 |
| 4,919,756 | 4/1990 | Sawdai | 101/423 |

FOREIGN PATENT DOCUMENTS

| | | | |
|---|---|---|---|
| 0000796 | 1/1897 | United Kingdom. | |
| 796 | 1/1897 | Sackville et al. | 101/423 |
| 3109630 | 2/1982 | Fed. Rep. of Germany | 101/425 |
| 0056263 | 4/1982 | Japan | 101/425 |
| 1434025 | 4/1976 | United Kingdom | 101/425 |

*Primary Examiner*—Edgar S. Burr
*Assistant Examiner*—Lynn Hendrickson
*Attorney, Agent, or Firm*—Phillip A. Rein

[57] ABSTRACT

This invention is a cylinder impurity remover apparatus mountable on a printing press assembly and having a wiper blade assembly to contact a rotating printing plate cylinder member to remove dust and impurities therefrom. The cylinder impurity remover apparatus includes 1) a main support assembly secured to the printing press assembly; 2) a remover actuator assembly mounted on the main support assembly; 3) a wiper blade assembly connected to an outer end of the remover actuator assembly; and 4) an actuator control assembly connected to the remover actuator assembly for operation thereof. The remover actuator assembly includes a spaced pair of main actuator assemblies, each having the wiper blade assembly connected to an outer end of the main shaft member. The actuator control assembly is selectively operable to supply pressure fluid to the main actuator assembly to cause longitudinal movement of the main shaft members to place a wiper blade member of the wiper blade assembly into contact with the rotating printing plate cylinder assembly for cleaning purposes.

13 Claims, 3 Drawing Sheets

CYLINDER IMPURITY REMOVER APPARATUS

PRIOR ART

A patent search on this invention revealed the following United States Patents:

| U.S. Pat. No. | Invention | Inventor |
|---|---|---|
| 4,082,038 | APPARATUS FOR AUTOMATICALLY REMOVING DUST FROM A FORM CYLINDER OF A PRINTING MACHINE | Ueno et al |
| 4,311,094 | METHOD AND APPARATUS FOR REMOVING FOREIGN MATTER FROM A PRINTING PRESS PLATE CYLINDER | Lloyd W. Ellison |
| 4,499,827 | SYSTEM FOR AUTOMATICALLY REMOVING DUST FROM PLATE CYLINDERS OF PRINTING PRESS | Takeuchi et al |
| 4,667,597 | PRINTING PRESS BLANKET CLEANER | Wright et al |
| 4,774,884 | METHOD FOR WASHING A GRAVURE PRINTING SYSTEM | Sugimoto et al |
| 4,782,756 | PRINTING PRESS ROLLER INK REMOVER | Paul C. Howard |
| 4,789,432 | DOCTORING APPARATUS | Goodnow et al |
| 4,852,492 | DEVICE FOR AFTERTREATING A COATED OR PRINTED MATERIAL WEB | Wolfgang Pfizenmaier |

The Ueno et al patent discloses an apparatus for automatically removing dust from a cylinder on a printing machine. This apparatus has a tip member to clean a cylinder that must be moved longitudinally to position properly on a printing cylinder and then actuated to remove dust or other impurities therefrom.

The Ellison patent discloses a method apparatus for removing foreign matter from a printing press rotating cylinder. This patent utilizes three (3) different blades being operable to continuously wipe an entire width of a rotating printing cylinder.

The Takeuchi et al patent discloses a system for automatically removing dust from a plate cylinder utilizing piston and cylinders, a slide carriage, and a dust removing head.

The Wright et al patent discloses a printing press blanket cleaner for removing dust, lint, and ink bubbles from a blanket cylinder.

The Sugimoto et al patent discloses a structure for cleansing a printing system.

The Howard patent discloses a printing press roller ink remover using a plurality of adjacent independent scraping blades.

The Goodnow et al patent discloses a doctoring apparatus used to clean a rotating cylinder having an actuator piston and cylinder; pivotal linkage structure; and a wiper blade.

The Pfizenmaier patent discloses a doctoring blade device having a blade engagable with a roller structure.

PREFERRED EMBODIMENT OF THE INVENTION

In one preferred embodiment of this invention, a cylinder impurity remover apparatus is attached to spaced, parallel side walls of a support frame of a printing press assembly and having a wiper blade assembly reciprocally movable to contact an outer surface of a printing plate cylinder member of a printing press assembly to remove dust particles and other impurities therefrom which is necessary to achieve a quality printing operation.

The cylinder impurity remover apparatus includes 1) a main support assembly having a primary support bar secured to the side wall members of the press support frame; 2) a remover actuator assembly mounted on the primary support bar; 3) a wiper blade assembly connected to outer ends of the remover actuator assembly; and 4) an actuator control assembly connected to the remover actuator assembly to move the wiper blade assembly inwardly and outwardly for wiping purposes on the printing plate cylinder member.

The remover actuator assembly includes spaced, identical units, each having 1) a main actuator assembly; 2) an adjustable stop assembly operably connected to the main actuator assembly to control lateral movement operation of the wiper blade assembly; and 3) a support shaft assembly connected to the main actuator assembly.

The wiper blade assembly includes a wiper anchor member secured to the spaced support shaft assembly and having a wiper blade member extended parallel to and against an outer surface of the printing plate cylinder member.

The actuator control assembly includes a fluid pressure supply tank connected through a control switch assembly to the main actuator assembly of the remover actuator assembly.

The actuator control assembly is selectively operable through the control switch assembly to actuate the main actuator assemblies to move the support shaft assemblies in a reciprocating axial direction so that the wiper blade member connected thereto moves axially to contact a plate support surface of the printing plate cylinder member for a wiping or cleaning operation.

OBJECTS OF THE INVENTION

One object of this invention is to provide a cylinder impurity remover apparatus which can be readily installed on new or existing printing press assemblies between adjacent roller members having a small clearance therebetween and having a wiper blade assembly which can be moved reciprocally axially a small distance to contact an outer surface of a printing plate cylinder member for wiping purposes.

Another object of this invention is to provide a cylinder impurity remover apparatus mounted in a minimum amount of space between rollers on a printing press assembly having a clearance slightly greater than a wiper blade member and the support structures connected thereto.

One other object of this invention is to provide a cylinder impurity remover apparatus including a wiper blade assembly engagable with an outer plate support surface of a printing plate cylinder member having an actuator control assembly for periodic operation by the printing press operator.

Still, one other object of this invention is to provide a cylinder impurity remover apparatus which is easily mounted on new or existing printing press assemblies; economical to manufacture; simple in operation; and requiring a minimum amount of repair and maintenance.

Various other objects, advantages, and features of the invention will become apparent to those skilled in the art from the following discussion, taken in conjunction with the accompanying drawings, in which:

FIGURES OF THE INVENTION

Figure 1:
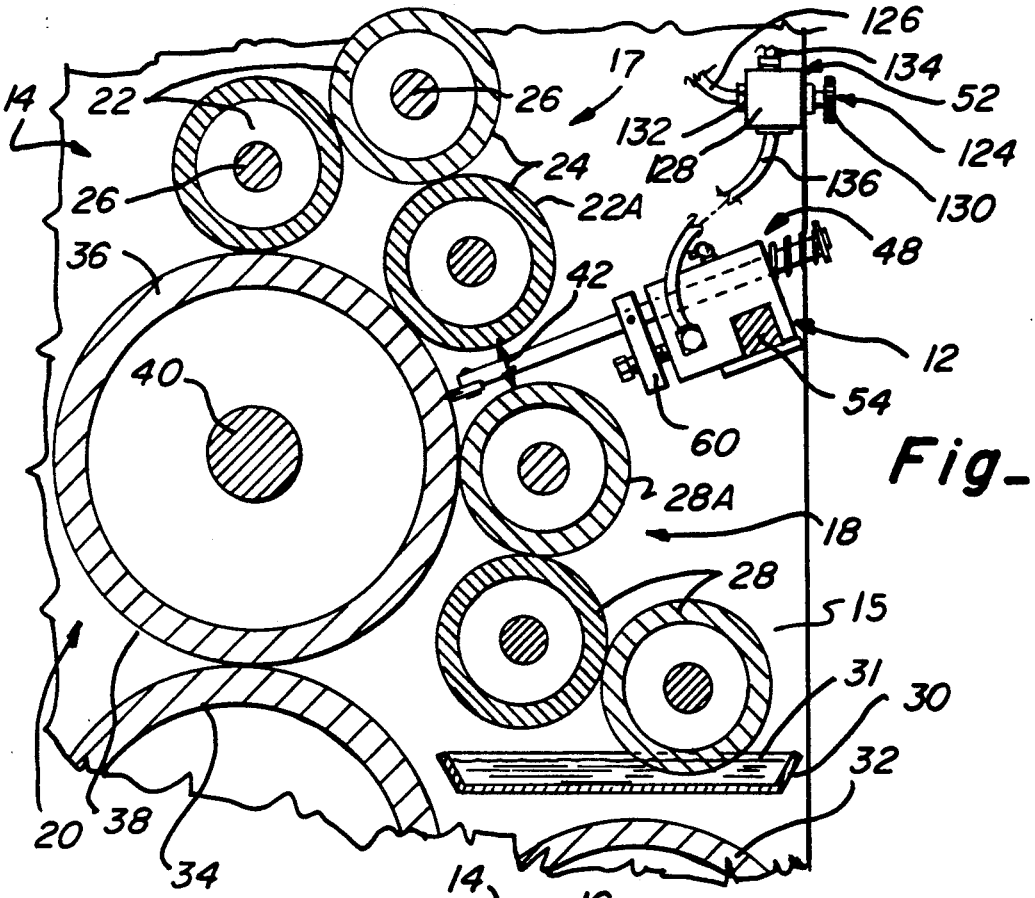
FIG. 1 is a fragmentary prespective elevational sectional view of a printing press assembly illustrating a cylinder impurity remover apparatus of this invention mounted thereon.
Figure 2:
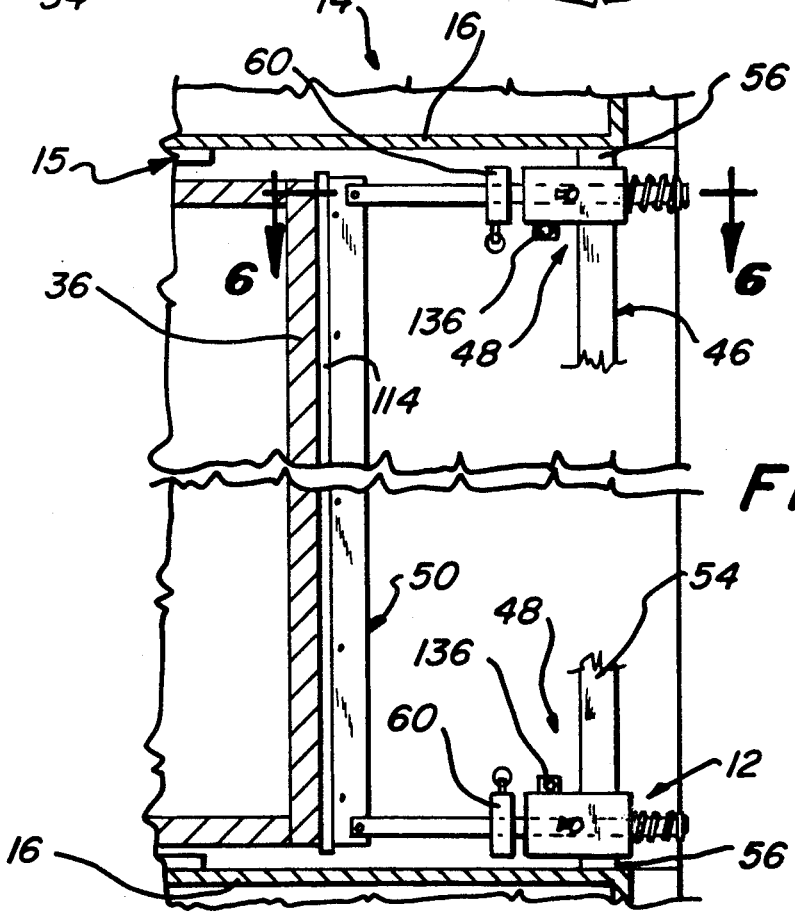
FIG. 2 is a fragmentary, foreshortened top plan view of the structure shown in FIG. 1.
Figure 3:
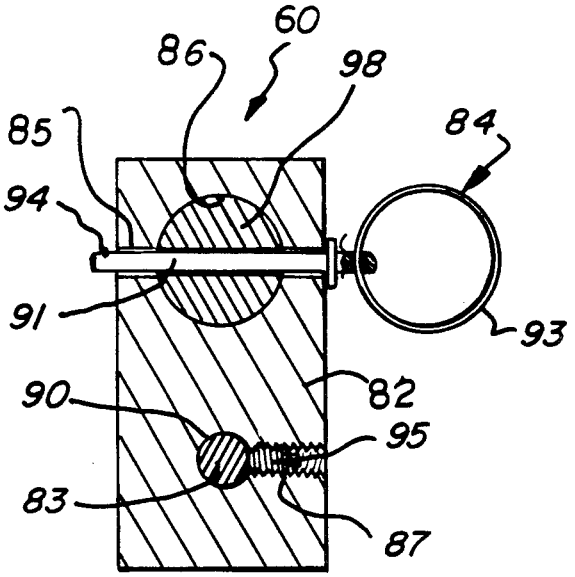
FIG. 3 is an enlarged sectional view taken along line 3—3 in FIG. 6.
Figure 4:
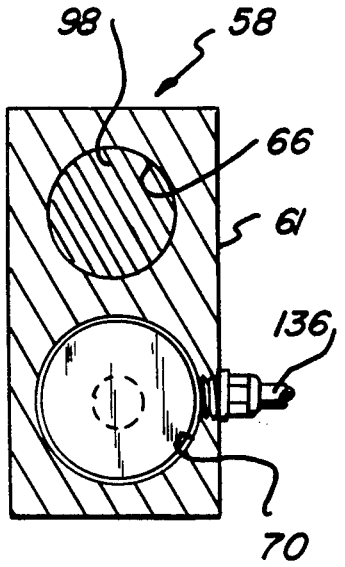
FIG. 4 is an enlarged sectional view taken along line 4—4 in FIG. 6.

The following is a discussion and description of preferred specific embodiments of the cylinder impurity remover apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a cylinder impurity remover apparatus of this invention, indicated generally at 12, is utilized on a printing press assembly 14 to remove dust and other impurities from a rotating printing plate cylinder member.

The printing press assembly 14 is of a conventional nature including a press support frame 15 having spaced, parallel side wall members 16 to which the cylinder impurity remover apparatus 12 is attached as will be explained.

As noted in FIG. 1, the printing press assembly 14 includes 1) an ink roller assembly 17; 2) a dampener roller assembly 18; and 3) a printing cylinder assembly 20. The ink roller assembly 17 includes intercontacting ink roller members 22, each having an outer ink contact surface 24 and connected to a roller support shaft 26 for rotational movement therewith.

The dampener roller assembly 18 includes intercontacting dampener roller members 28 having one roller member 28 operably engagable with a fluid container pan 30.

The fluid container pan 30 is continuously supplied with a fluid level 31 so as to continuously contact an outer surface of the adjacent dampener roller member 28 to transfer the fluid to a contacting roller member 28. This contacting roller member 28 engages a dampener roller member 28A to transfer the fluid onto a portion of the printing cylinder assembly 20 as noted in FIG. 1.

The printing cylinder assembly 20 is provided with 1) a transfer cylinder member 32; 2) a blanket cylinder member 34; and 3) a printing plate cylinder member 36. The transfer cylinder member 32, blanket cylinder member 34, and the printing plate cylinder member 36 well known in the prior art being used in printing press operations.

The printing plate cylinder member 36 is operable to receive a printing plate member thereon for transfer of images therefrom. The printing plate cylinder member 36 includes an outer plate support surface 38 and being rotatable with a central plate support shaft 40.

It is to be noted that a specific ink roller member 22A and the dampener roller member 28A have a small clearance indicated at 42 therebetween which is the normal clearance found in the printing press assembly 14. The cylinder impurity remover apparatus 12 of this invention is designed so as to be operable in spite of the small clearance 42 between the adjacent ink roller member 22A and the dampener roller member 28A.

The cylinder impurity remover apparatus 12 includes 1) a main support assembly 46 connected to the printing press assembly 14; 2) a remover actuator assembly 48 connected to the main support assembly 46; 3) a wiper blade assembly 50 connected to the remover actuator assembly 48; and 4) an actuator control assembly 52 connected to the remover actuator assembly 48 for operation thereof as will be explained.

The main support assembly 46 includes an elongated primary support bar 54 of square or rectangular shape in transverse cross section having outer anchor end sections 56 which are secured to adjacent portions of the respective side wall members 16 of the print press assembly 14.

The remover actuator assembly 48 includes 1) a pair of main actuator assemblies 58, each mounted on respective opposite anchor end sections 56 of the primary support bar 54; 2) an adjustable stop assembly 60 secured to each of the main actuator assemblies 58; and 3) a support shaft assembly 62 connected to respective ones of the main actuator assemblies 58.

The main actuator assemblies 58 are identical and, therefore, only one need be described in detail. The main actuator assembly 58 includes 1) an actuator housing 61; and 2) an actuator piston assembly 63 connected to the actuator housing 61.

The actuator housing 61 is provided with 1) a shaft opening or hole 66; 2) a zerk opening 67; 3) a support bar slot 68; and 4) an actuator piston opening 70.

The zerk opening 67 is adapted to receive a grease zerk member 71 therein for lubrication purposes in a conventional manner.

The actuator piston assembly 63 includes 1) a floating piston 72 mounted within the actuator piston opening 70; 2) O-ring members 74 mounted within O-ring grooves 76 in the floating piston 72; and 3) a retainer ring member 77. The retainer ring member 77 is mounted within a groove in the actuator piston opening 70 of the actuator housing 61 to hold the floating piston 72 therein but permits it to be removed for repair and maintenance.

The bar anchor assembly 64 includes an anchor plate 78 secured by anchor bolt members 80 about the support bar slot 68 to retain the primary support bar 54 of the main support assembly 46 therein as will be noted.

The adjustable stop assembly 60 includes 1) a stop housing 82; 2) an adjustable bolt member 83; and 3) a lock pin member 84.

The stop housing 82 is provided with 1) a lock pin opening 5; 2) a shaft opening 86; 3) a threaded set screw hole 87; and 4) an adjustable bolt opening 88. The adjustable bolt opening 88 has internal threads 89 therein.

The adjustable bolt member 83 is adapted to be threadably mounted within the adjustable bolt opening 88 having external threads 90 thereon and a head section 92.

The lock pin member 84 is operable to be selectively inserted within the lock pin opening 85 in the stop housing 82. The lock pin member 84 includes a main pin body 91 having a pull ring 93 connected thereto. The main pin body 91 is provided with a detent member 94 at one end thereof for retaining within the lock pin opening 85 but easily removed therefrom on movement of the pull ring 93 attached to the main pin body 91 in a conventional manner.

The support shaft assembly 62 is provided with a main shaft member 96 operable with a biasing means or member 97.

Figure 5:
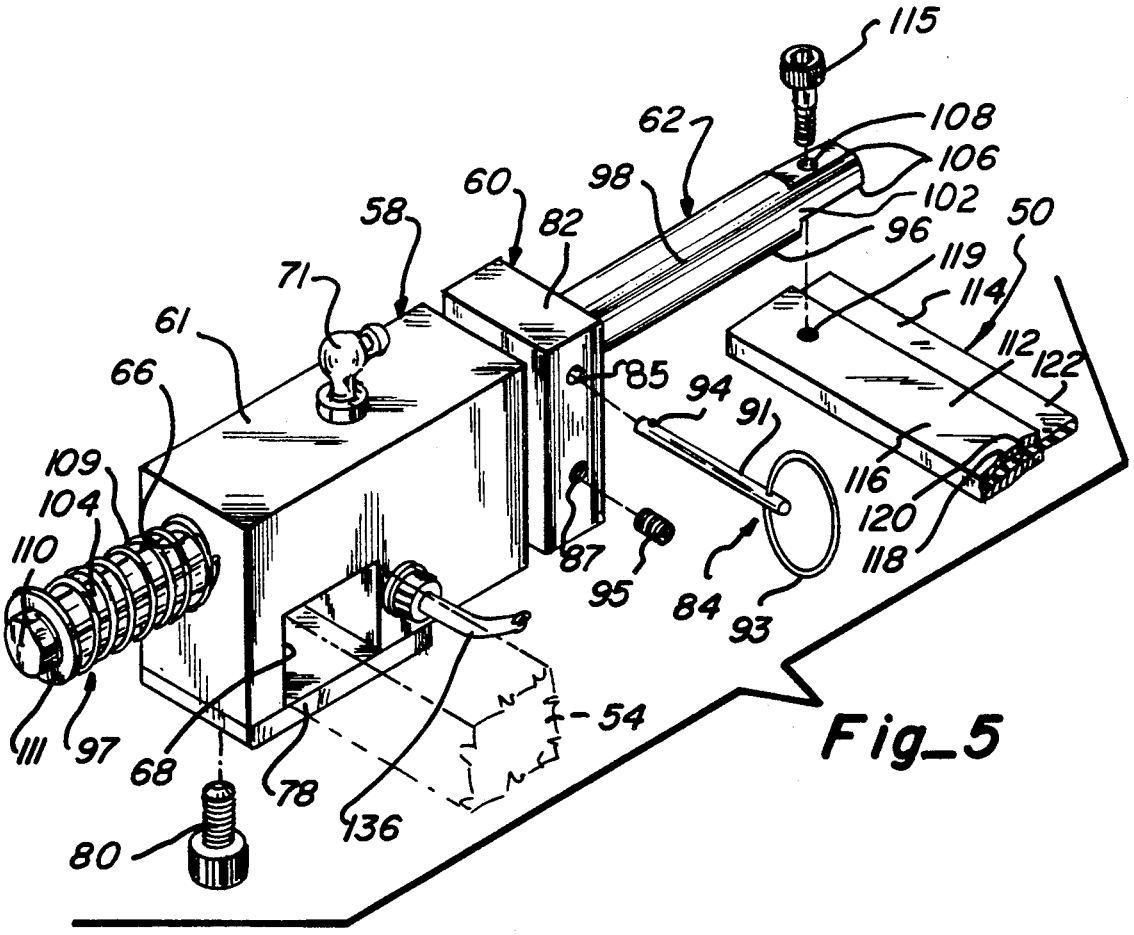
FIG. 5 is an enlarged exploded perspective view of a remover actuator assembly of the cylinder impurity remover apparatus of this invention.

As noted in FIG. 5., the main shaft member 96 consists of 1) a main body section 98; 2) a wiper connector section 102; and 3) a bias end section 104. The wiper connector section 102 is provided with a stepped portion 106 having a blade anchor hole 108 therein.

The biasing means or member 97 consists of a compression spring member 109 mounted about the bias end section 104 of the main shaft member 96. The compression spring member 109 is engageable at one end with an anchor bolt 110 secured to an outer end of the main shaft member 96. A washer member 111 is mounted about the bias end section 104 to receive one end of the compression spring member 109 thereagainst.

As illustrated in FIG. 5, the wiper blade assembly 50 includes 1) a blade anchor member 112; 2) a wiper blade member 114; and 3) a blade connector bolt 115. The blade anchor member 112 is provided with 1) an anchor body 116; 2) a blade connector slot 118; and 3) a threaded connector hole 119.

The wiper blade member 114 is constructed of a resilient material such as rubber and provided with an anchor portion 120 integral with a blade tip portion 122. The blade tip portion 122 is operable to engage the plate support surface 38 of the printing plate cylinder member 36 in a manner to be explained.

The blade connector bolt 115 is operable to be placed through the blade anchor hole 108 for securing the wiper connector section 102 of the main shaft member 96 to the blade anchor member 112 of the wiper blade assembly 50.

The actuator control assembly 52 is preferrably secured to the press support frame 15 as noted in FIG. 1. The actuator control assembly 52 includes a fluid pressure supply tank (not shown) connected by a pressure fluid supply line 126 to a control switch assembly 124 which, in turn, is connected to respective ones of the main actuator assemblies 58. The pressure fluid supply line 126 receives and supplies fluid pressure, such as air, to the control switch assembly 124.

As noted in FIG. 1, the control switch assembly 124 includes 1) a switch housing 128; 2) an actuator plunger 130 mounted within the switch housing 128; 3) a fluid inlet opening 132; 4) an exhaust port 134; and 5) a fluid transfer line 136 which supplies pressure fluid conjointly to respective ones of the main actuator assemblies 58.

The actuator plunger 130 is in a normally open condition to 1) exhaust fluid within the fluid transfer line 136 to the atmosphere through the exhaust port 134; and 2) close fluid pressure from the pressure fluid supply line 126.

USE AND OPERATION OF THE INVENTION

In the use and operation of the cylinder impurity remover apparatus 12 of this invention, it can be readily installed on new or existing printing press assemblies 14 with the main purpose and function to provide means for contacting the plate support surface 38 of the printing plate cylinder member 36 to remove dust and other impurities therefrom to achieve a quality printing operation.

The cylinder impurity remover apparatus 12 is specially constructed and designed so as to achieve a reciprocal movement of the wiper blade member 114 between the close proximity of the ink roller member 22A and dampener roller member 28A (clearance 42) which is a normal close relationship found on printing press assemblies 14 of the prior art.

On an existing printing press assembly 14, the first step would be to secure the primary support bar 54 by its outer respective anchor end sections 56 to an adjacent respective side wall member 16 of the press support frame 15.

Figure 7:
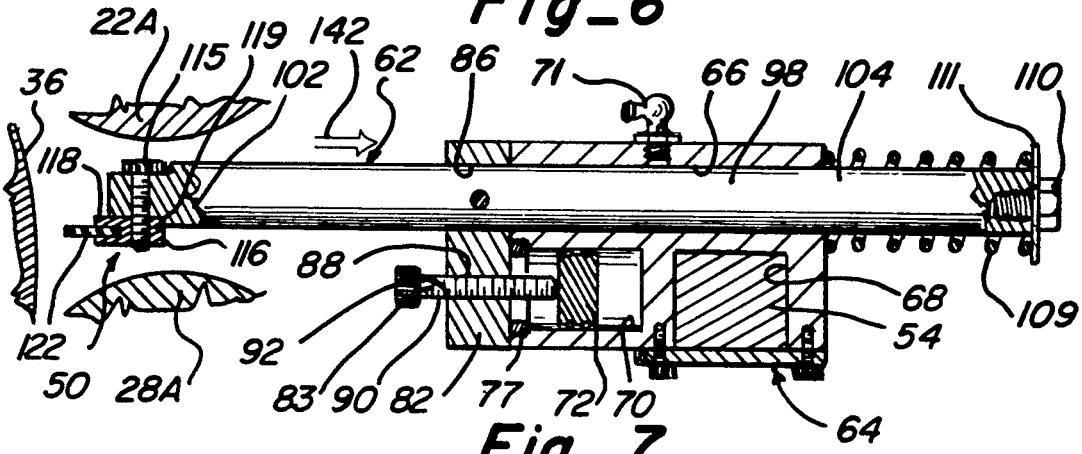
FIG. 7 illustrates movement from contact with the printing press cylinder member as noted in FIG. 6 to a retracted position.

At this time, the primary support bar 54 may have the remover actuator assembly 48 connected thereto with the support shaft assemblies 62 held in the retracted position due to the operation of the compression spring members 109 and would then resemble the retracted position as shown in FIG. 7.

Next, the actuator control assembly 52 and, more specifically, the control switch assembly 124 is attached to a position convenient to the operator to the press support frame 15 such as noted in FIG. 1.

The control switch assembly 124 is then connected by the pressure fluid supply line 126 to the fluid pressure supply tank (not shown) which can be continuously supplied with and store a pressure fluid such as compressed air.

The control switch assembly 124 is connected through the fluid transfer line 136 to respective ones of the main actuator assemblies 58 to selectively supply pressure to the respective actuator piston assemblies 63.

In the normal unactuated condition, the control switch assembly 124 through the actuator plunger 130 seals off pressure from the pressure fluid supply line 126 but allows pressure within the fluid transfer line 136 to be vented through the exhaust port 134 to the atmosphere.

Figure 6:
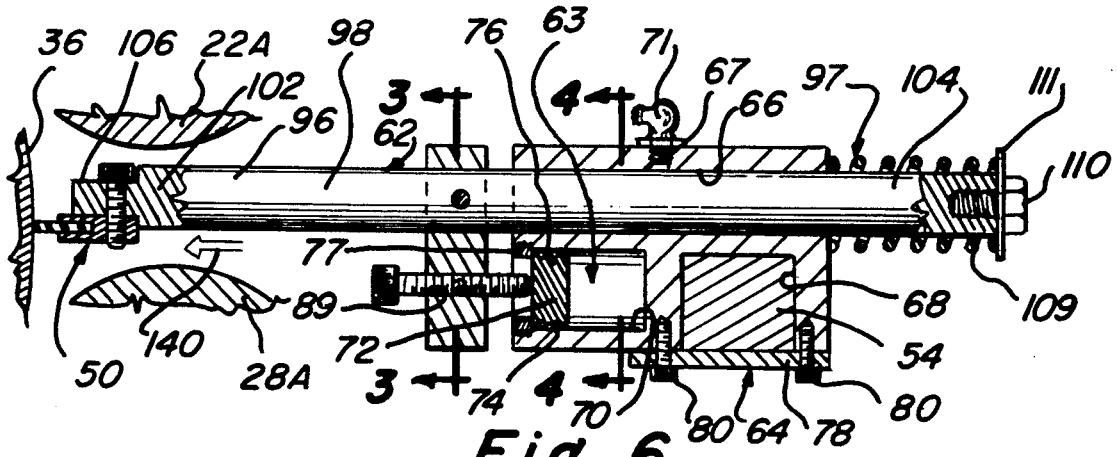
FIG. 6 is an enlarged sectional view taken along line 6—6 in FIG. 1 illustrating the cylinder impurity remover apparatus in an impurity removing position contacting a printing press cylinder member.

Next, the adjustable stop assemblies 60 are respectively anchored to the main shaft members 96 through the lock pin members 84 and can be independently adjusted through rotation of the bolt members 83 in order to engage an outer surface of the floating pistons 72. This operates to adjust positioning of the wiper blade assembly 50 relative to the printing plate cylinder member 36 as shown in FIG. 6. This regulates movement of the main shaft members 96 and the wiper blade assembly 50 and resultant pressure of the blade tip portion 122 against the plate support surface 38 (or surface of a printing plate mounted therein) of the printing plate cylinder member 36.

With the cylinder impurity remover apparatus 12 in the assembled and retracted condition of FIG. 7, the operator of the printing press assembly 14 depresses the actuator plunger 130 which thereupon allows fluid pressure to flow from the pressure fluid supply line 126 to the fluid transfer lines 136 connected to the main actuator assemblies 58.

The fluid pressure thereupon acts on the respective floating pistons 72 moving the main shaft members 96 forwardly as noted by an arrow 140 in FIG. 6. This places the outer blade tip portion 122 against the plate support surface 38 of the printing plate cylinder member 36. This action provides a wiping action against the plate support surface 38 as the printing cylinder assembly 20 rotates to remove small particles such as dust and other impurities therefrom.

As long as the operator depresses the actuator plunger 130, the blade tip portion 122 continues its wiping action against the rotating plate support surface 38.

The operator would continue to depress the actuator plunger 130 for a sufficient time period to complete at least one revolution of the printing plate cylinder member 36 in order to wipe all of the debris therefrom.

On release of the actuator plunger 130, actuator plunger 130 no longer supplies pressure fluid from the pressure fluid supply line 126 to the fluid transfer lines 136. The fluid transfer lines 136 are then aligned with the exhaust port 134 so that there is no pressure therein acting on the floating piston 72.

At this time, it is noted that the compression spring members 109, acting against a rear surface of the respective actuator housings 61 and the washer members 111, operate to move the main shaft members 96 in a rearward direction to the retracted condition noted by an arrow 142 in FIG. 7.

Figure 8:
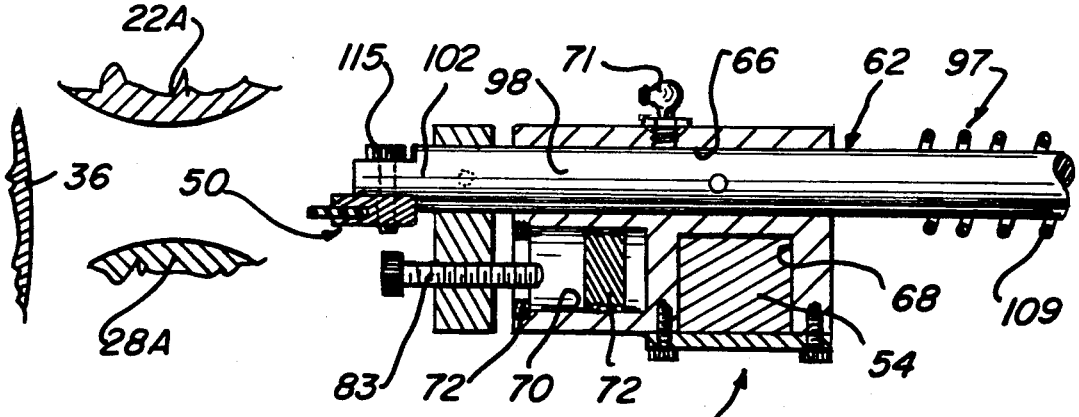
FIG. 8 is similar to FIG. 6 illustrating movement of the remover actuator assembly to a fully retracted position for repair and maintenance.

In the repair and maintenance of a main actuator assembly 58 of the cylinder impurity remover apparatus 12 as noted in FIG. 8, the lock pin member 84 is removed from the lock pin opening 85 so that the main shaft member 96 is moved to a fully retracted position so that the press operator can gain access to work on the wiper blade assembly 50 for repair and maintenance. It is obvious that the wiper blade member 114 would need to be cleansed plus periodically replaced due to wear on the blade tip portion 122.

It is noted that the cylinder impurity remover apparatus 12 of this invention is operable to provide a short reciprocal movement of the wiper blade assembly 50 to achieve the wiping action which is not achieved by the prior art structures used to cleanse a printing plate cylinder member.

The cylinder impurity remover apparatus can be attached to new or existing printing press assemblies requiring minimum skill for assembly thereof; being semi-automatic in operation; economical to manufacture; and substantially maintenance free.

While the invention has been described in conjunction with preferred specific embodiments thereof, it will be understood this description is intended to illustrate and not to limit the scope of the invention, which is defined by the following claims:

I claim:

1. A cylinder impurity remover apparatus operable to remove impurities from a rotatable printing plate cylinder member on a printing press assembly, comprising:

a) a main support assembly having a primary support bar adapted to be connected to a printing press assembly;

b) a remover actuator assembly having a main actuator assembly connected to said primary support bar and a support shaft assembly reciprocally connected to said main actuator assembly;

c) a wiper blade assembly having a wiper blade member connected to a main shaft member of said support shaft assembly;

d) an actuator control assembly connected to said main actuator assembly and operable to selectively move said main shaft member to place said wiper blade member in contact with the printing plate cylinder member to remove impurities therefrom on rotation of the printing plate cylinder member;

e) said actuator control assembly includes a control switch assembly connected to a fluid pressure supply tank to provide fluid pressure to said main actuator assembly; and f) said control switch assembly having an actuator plunger which is operable in one position to provide fluid pressure to said main actuator assembly to cause reciprocal movement of said main shaft member from a retracted to an extended operating position with said wiper blade member into contact with the printing plate cylinder member and, in another position of said actuator plunger, pressure fluid supply from the storage tank to said main actuator assembly is ceased and said main actuator assembly operates to move said main shaft member to a retracted position with said wiper blade member out of contact with the printing plate cylinder member.

2. A cylinder impurity remover apparatus operable to remove impurities from a rotatable printing plate cylinder member on a printing press assembly, comprising:

a) a main support assembly having a primary support bar adapted to be connected to a printing press assembly;

b) a remover actuator assembly having a main actuator assembly connected to said primary support bar and a support shaft assembly reciprocally connected to said main actuator assembly;

c) a wiper blade assembly having a wiper blade member connected to a main shaft member of said support shaft assembly;

d) an actuator control assembly mounted on the printing press assembly and connected to said main actuator assembly and operable to selectively move said main shaft member to place said wiper blade member in contact with the printing plate cylinder member to remove impurities therefrom on rotation of the printing plate cylinder member; and e) said support shaft assembly having a bias member mounted on said main shaft member operable to move said main shaft member to a retracted position when said actuator control assembly is not actuated to move with said wiper blade member out of contact with the printing plate cylinder member.

3. A cylinder impurity remover apparatus as described in claim 2, wherein:

a) said main actuator assembly includes an actuator housing having an actuator piston assembly mounted thereon;

b) said actuator piston assembly includes a floating piston which is moved by said actuator control assembly and, in turn, moves said main shaft member from a retracted to an extended cylinder contacting position of said wiper blade member; and c) said remover actuator assembly includes an adjustable stop assembly connected to said main shaft member engagable with said floating piston to adjustably pre-select axial movement of said main shaft member and resultant contact of said wiper blade member with the printing plate cylinder member.

4. A cylinder impurity remover apparatus as described in claim 2, wherein:

a) said remover actuator assembly includes an adjustable stop assembly connected to said main shaft member in a position adjacent and in contact with said main actuator assembly; and b) said adjustable stop assembly having a stop housing with an adjustable member and said adjustable member engagable with said main actuator assembly to axially position said main shaft member to adjustably regulate the reciprocal movement thereof from an extended to a retracted position.

5. A cylinder impurity remover apparatus as described in claim 4, wherein:

a) said adjustable member operable to be adjusted to selectively position said wiper blade assembly relative to the printing plate cylinder member to assure proper contact of said wiper blade member with an outer surface of the printing plate cylinder member.

6. A cylinder and impurity remover apparatus as described in claim 2, wherein:

a) said support shaft assembly includes said bias member mounted about said main shaft member and engagable with said main actuator assembly; and b) said bias member operable to move said main shaft member automatically to a retracted position with said wiper blade member out of contact with the printing plate cylinder member.

7. A cylinder impurity remover apparatus operable to remove impurities from a rotatable printing plate cylinder member on a printing press assembly, comprising:

a) a main support assembly connected to the printing press assembly;

b) a remover actuator assembly connected to said main support assembly;

c) a wiper blade assembly connected to said remover actuator assembly having a wiper blade member positioned in parallel adjacent relationship to the printing plate cylinder member;

d) an actuator control assembly connected to said main actuator assembly to control operation thereof;

e) said remover actuator assembly includes a main actuator assembly connected to said main support assembly, a shaft support assembly reciprocally mounted on said main actuator assembly, and an adjustable stop assembly mounted on said support shaft assembly and engagable with said main actuator assembly;

f) said actuator control assembly operably connected to said main actuator assembly to control axial movement of a main shaft member of said support shaft assembly to cause movement of said wiper blade member into contact with an outer surface of the printing plate cylinder member in a cleansing function thereagainst;

g) said adjustable stop member having a stop housing mounted on said main shaft member and an adjustable member adjustably mounted in said stop housing and engagable with said main actuator assembly being operable to regulate an amount of reciprocal movement of said main shaft member to assure proper pressure of said wiper blade member against the outer surface of the printing plate cylinder member; and h) said adjustable stop assembly includes a lock pin member mounted in said stop housing and connected to said main shaft member;

whereby said lock pin member is removable to permit axial movement of said main shaft member for ease of repair and maintenance of said wiper blade assembly.

8. A cylinder impurity remover apparatus operable to remove impurities from a rotatable printing plate cylinder member on a printing press assembly, comprising:

a) a main support assembly connected to the printing press assembly;

b) a remover actuator assembly connected to said main support assembly;

c) a wiper blade assembly connected to said remover actuator assembly having a wiper blade member positioned in parallel adjacent relationship to the printing plate cylinder member;

d) an actuator control assembly connected to said main actuator assembly to control operation thereof;

e) said remover actuator assembly includes a main actuator assembly connected to said main support assembly, a shaft support assembly reciprocally mounted on said main actuator assembly, and an adjustable stop assembly mounted on said support shaft assembly and engagable with said main actuator assembly; and f) said actuator control assembly operably connected to said main actuator assembly to control axial movement of a main shaft member of said support shaft assembly to cause movement of said wiper blade member into contact with an outer surface of the printing plate cylinder member in a cleansing function thereagainst.

9. A cylinder impurity remover apparatus as described in claim 8, wherein:

a) said adjustable stop member having a stop housing mounted on said main shaft member and an adjustable member adjustably mounted in said stop housing and engagable with said main actuator assembly being operable to regulate an amount of reciprocal movement of said main shaft member to assure proper pressure of said wiper blade member against the outer surface of the printing plate cylinder member.

10. A cylinder impurity remover apparatus as described in claim 8, wherein:

a) said support shaft assembly includes a bias member mounted about an outer end of said main shaft member to move same to a retracted position with said wiper blade member out of contact with the printing plate cylinder member.

11. A cylinder impurity remover apparatus as described in claim 8, wherein:

a) said shaft support assembly includes a bias member engagable with said main actuator assembly and said main shaft member to position said wiper blade member out of contact with the printing plate cylinder member.

12. A cylinder impurity remover apparatus as described in claim 8, wherein:

a) said main actuator assembly includes an actuator piston assembly engagable with said adjustable stop assembly to adjustably control axia movement of said main shaft member and interconnected said wiper blade member.

13. A cylinder impurity remover apparatus as described in claim 12, wherein:

a) said adjustable stop assembly includes an axially movable adjustable bolt member which contacts said actuator piston assembly to cause axial movement of said main shaft member.

* * * * *